US009982457B2

(12) United States Patent
Chen

(10) Patent No.: US 9,982,457 B2
(45) Date of Patent: May 29, 2018

(54) ANTI-THEFT DEVICE FOR DOOR LOCKS

(71) Applicant: Te-Yu Chen, Pingtung (TW)

(72) Inventor: Te-Yu Chen, Pingtung (TW)

( * ) Notice: Subject to any disclaimer, the term of this patent is extended or adjusted under 35 U.S.C. 154(b) by 123 days.

(21) Appl. No.: 15/076,669

(22) Filed: Mar. 22, 2016

(65) Prior Publication Data

US 2017/0275920 A1 Sep. 28, 2017

(51) Int. Cl.

| | |
|---|---|
| ***E05B 59/00*** | (2006.01) |
| ***E05B 17/22*** | (2006.01) |
| ***E05C 1/08*** | (2006.01) |
| *E05B 63/00* | (2006.01) |
| *E05B 17/20* | (2006.01) |
| *E05C 9/00* | (2006.01) |

(52) U.S. Cl.

CPC ..... *E05B 17/22* (2013.01); *E05C 1/08* (2013.01); *E05B 17/2003* (2013.01); *E05B 17/2007* (2013.01); *E05B 63/00* (2013.01); *E05C 9/00* (2013.01); *E05Y 2900/132* (2013.01)

(58) Field of Classification Search

CPC ..... E05B 17/22; E05B 63/00; E05B 65/0014; E05B 17/2003; E05B 17/2007; E05B 17/2084; E05B 17/2015; E05B 17/2019; E05B 17/2069; E05B 17/208; E05B 17/2088; E05B 13/004; E05B 55/003; E05B 55/005; E05B 55/00; E05B 27/08; E05B 63/244; E05B 63/0017; E05B 63/06; E05C 1/08; E05C 21/00; E05C 9/00; E05C 9/046; E05C 9/047; E05C 9/14; E05C 1/04; E05Y 2900/132

See application file for complete search history.

(56) References Cited

U.S. PATENT DOCUMENTS 470,474 A * 3/1892 Colley ..... E05B 63/0017 70/129
4,330,146 A * 5/1982 Sessions, Jr. ..... E05C 19/182 292/258
4,384,465 A * 5/1983 Muus ..... E05B 13/005 292/172
4,708,378 A * 11/1987 Ingenhoven ..... E05B 81/25 292/201
4,751,834 A * 6/1988 Beck ..... E05B 17/2088 292/346
4,974,886 A * 12/1990 Kleefeldt ..... E05B 81/06 292/201
5,035,128 A * 7/1991 Ridgway ..... E05B 13/04 70/211

(Continued)

*Primary Examiner* — Suzanne L Barrett
*Assistant Examiner* — Morgan J McClure
(74) *Attorney, Agent, or Firm* — Leong C. Lei

(57) ABSTRACT

The anti-theft device is configured in a door lock, and contains a first blocking piece, a second blocking device, a positioning piece, and a lever. The first blocking piece contains a first section and a second section bended and extended perpendicularly from the first section. The first section has a first through hole and a second through hole. The lever is engaged by a lock heart of the door lock. When the door lock is locked, the lock heart is turned to engage the lever so that the lever drives the first blocking piece downward by its first through hole. The second section of the first blocking piece as such blocks a lock tongue of the door lock so that the door lock cannot be opened without using key.

3 Claims, 4 Drawing Sheets

(56) References Cited

U.S. PATENT DOCUMENTS

| | | | | |
|---|---|---|---|---|
| 5,503,441 | A * | 4/1996 | Schwaiger | E05B 81/25 292/142 |
| 6,019,402 | A * | 2/2000 | Arabia, Jr. | E05B 81/06 292/201 |
| 6,217,087 | B1 * | 4/2001 | Fuller | E05B 55/00 292/33 |
| 6,926,316 | B2 * | 8/2005 | Patire | E05C 19/182 292/290 |
| 9,068,381 | B2 * | 6/2015 | Segev | E05B 47/0669 |
| 9,518,421 | B2 * | 12/2016 | Cushwa, Jr. | E06B 5/10 |
| 2003/0127865 | A1 * | 7/2003 | Gartner | E05B 17/2034 292/195 |
| 2008/0073916 | A1 * | 3/2008 | Min | E05B 47/0603 292/201 |
| 2011/0187131 | A1 * | 8/2011 | Ploskunak | E05C 1/00 292/164 |
| 2013/0019643 | A1 * | 1/2013 | Tagtow | E05B 17/2034 70/361 |
| 2016/0160535 | A1 * | 6/2016 | Haidvogl | E05B 47/0607 312/212 |
| 2017/0030112 | A1 * | 2/2017 | Kane | E05B 59/00 |
| 2017/0122003 | A1 * | 5/2017 | Maniaci | E05B 15/0086 |
| 2017/0211300 | A1 * | 7/2017 | Fehr | E05C 1/16 |

* cited by examiner

ANTI-THEFT DEVICE FOR DOOR LOCKS

TECHNICAL FIELD OF THE INVENTION

The present invention is generally related to door locks, and more particular to an anti-theft device configured in a door lock that, when the door lock is locked, prevents the door lock from opening from inside the house without using a key to the door lock.

DESCRIPTION OF THE PRIOR ART

For a conventional door lock, it usually can be unlocked from inside the house without using a key to the door lock. Therefore, when a burglar breaks into the house, for example, from a window, the door lock can be easily opened by the burglar and provides no protection at all. The burglar then can easily move his loot through the door which is supposed to be locked so that some inconvenience is brought upon the burglar. In other words, the conventional door lock guards against breaking-in from outside the house only, and provides no protection once the security to the house is compromised.

SUMMARY OF THE INVENTION

Therefore, a major objective of the present invention is to provide an anti-theft device for a door lock so that, when the door lock is locked, it cannot be opened from inside the house without using a key to the door lock.

The anti-theft device is configured in a door lock, and contains a first blocking piece, a second blocking device, a positioning piece, and a lever. The first blocking piece has an L-like shape, and contains a first section and a second section bended and extended perpendicularly from the first section. The first section has a first through hole and a second through hole. The second blocking piece has a hook at one end. A torsion spring and the second blocking piece are sequentially in this order and rotatably joined to the first blocking piece so that the second blocking piece becomes elastic. The lever is engaged by a lock heart of the door lock. When the door lock is locked, the lock heart is turned to engage the lever so that the lever drives the first blocking piece downward by its first through hole. The second section of the first blocking piece as such blocks a lock tongue of the door lock so that the door lock cannot be opened without using key. When the door lock is unlocked and the lock heart is turned towards the other direction, the first blocking piece is moved upward to release its blocking to the lock tongue and a bulge of the positioning piece is embedded into the second through hole so that the door lock remains in an unlocked state.

Preferably, the positioning piece described above is a torsion spring.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become apparent to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
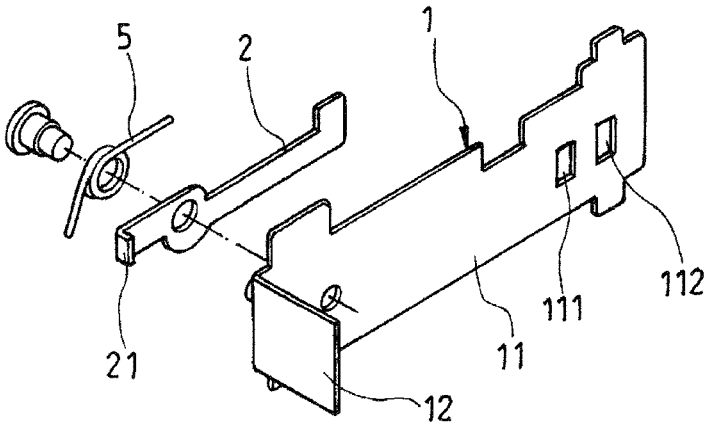
FIG. 1 is a perspective diagram showing the various components of an anti-theft device for a door lock according to an embodiment of the present invention.
Figure 2:
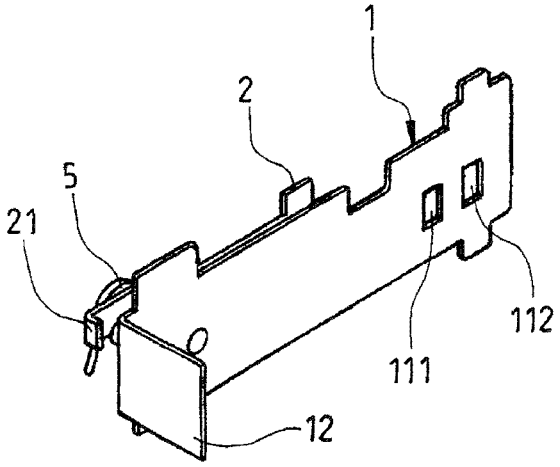
FIG. 2 is a perspective diagram showing the anti-theft device of FIG. 1 after its assembly.
Figure 3:
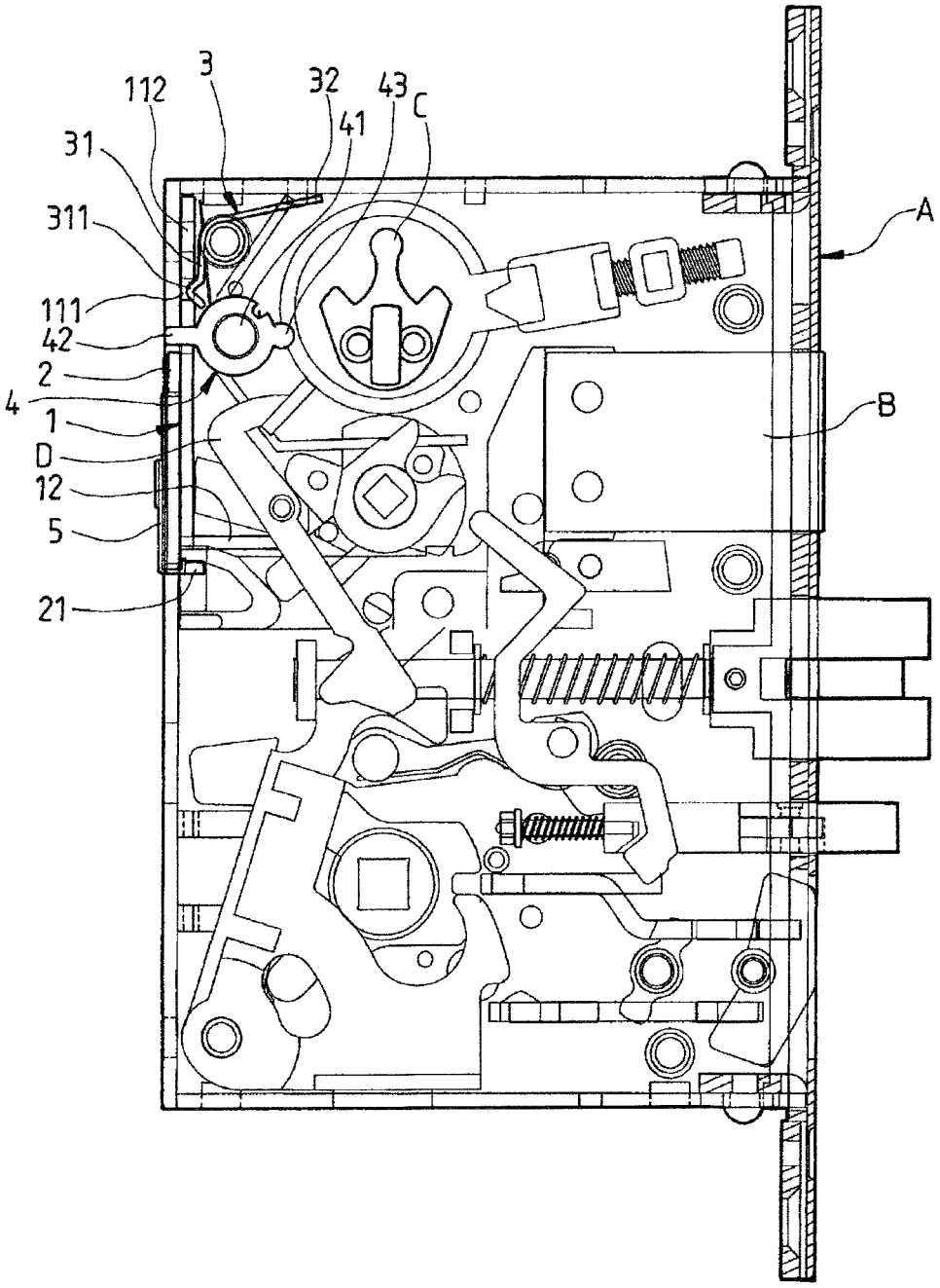
FIG. 3 is a schematic diagram showing the anti-theft device of FIG. 1 configured in a door lock.

FIG. 1 is a perspective diagram showing the various components of an anti-theft device for a door lock according to an embodiment of the present invention. FIG. 2 is a perspective diagram showing the anti-theft device of FIG. 1 after its assembly. FIG. 3 is a schematic diagram showing the anti-theft device of FIG. 1 configured in a door lock. As illustrated, the anti-theft device is configured in a door lock A, and contains a first blocking piece 1, a second blocking device 2, a positioning piece 3, and a lever 4. The first blocking piece 1 has an L-like shape, and contains a first section 11 and a second section 12 perpendicularly connected to the first section 11. The first section 11 has a first through hole 111 and a second through hole 112. The second blocking piece 2 has a hook at one end. A torsion spring 5 and the second blocking piece 2 are sequentially in this order and rotatably joined to the first blocking piece 1.

The positioning piece 3 has an appropriate elasticity. In the present embodiment, the positioning piece 3 is a torsion spring having a first end segment 31 and a second end segment 32 both extended for appropriate lengths. The first end segment 31 has a bulge 311. The positioning piece 3 is positioned such that the second end segment 32 is against an internal wall of the door lock A and such that the bulge 311 provides locking to the first blocking piece 1.

The lever 4 contains an axle 41, and a first pin 42 and a second pin 43 extended radially from the axle 41 and diametrically opposing each other.

Figure 4:
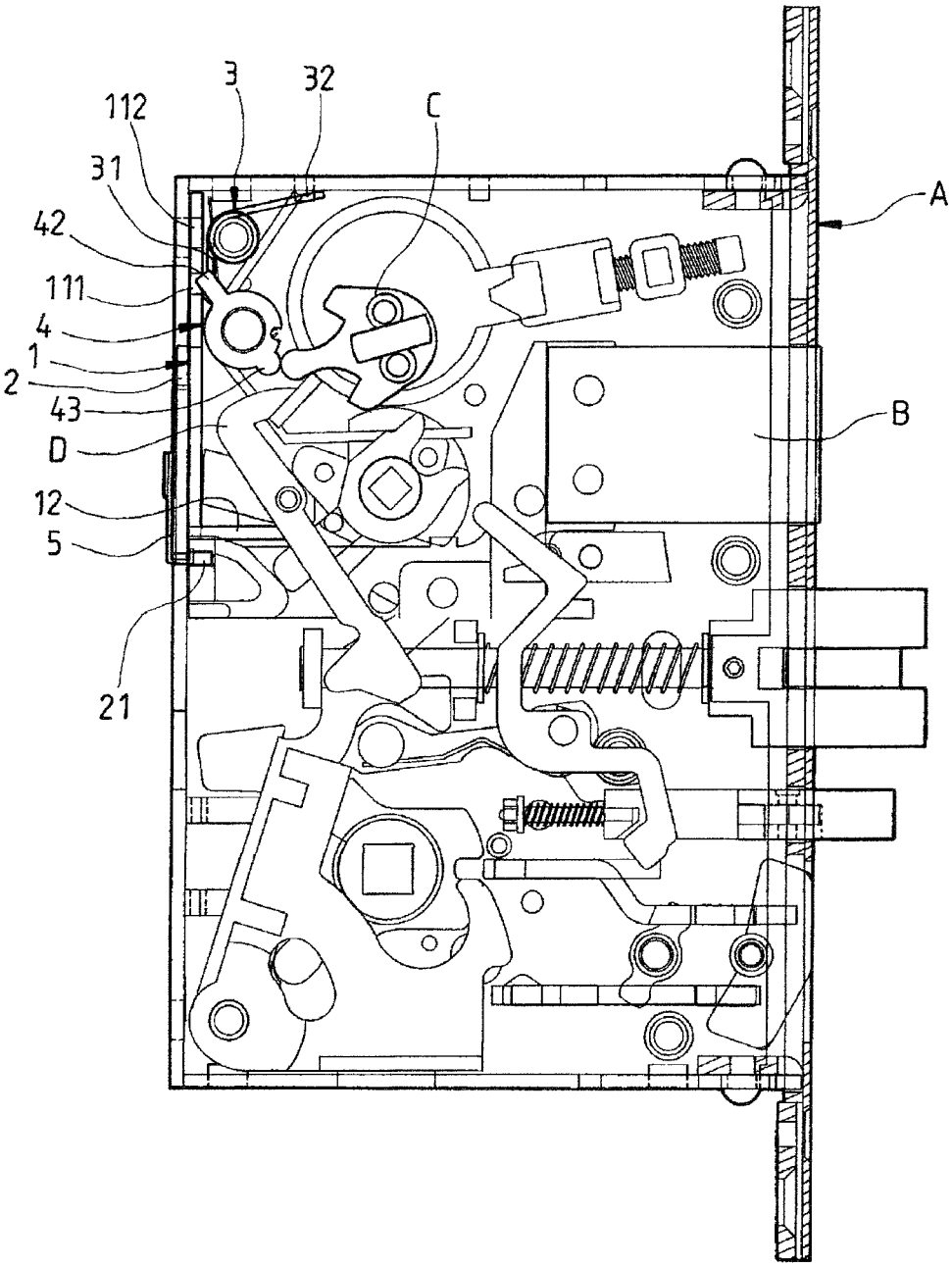
FIG. 4 is a schematic diagram showing a scenario when a door lock employing the anti-theft device of FIG. 1 is in an-unlocked state.

The anti-theft device functions as follows. FIG. 4 is a schematic diagram showing a scenario when a door lock A is in an-unlocked state. As illustrated, the first blocking piece 1 is at an upper position and its second section 12 does not block a lock tongue B of the door lock A, whereas the bulge 311 of the positioning piece 3 is embedded in the second through hole 112 so that the first blocking piece 1 cannot move downward. The door lock A therefore remains in the unlocked state.

Figure 5:
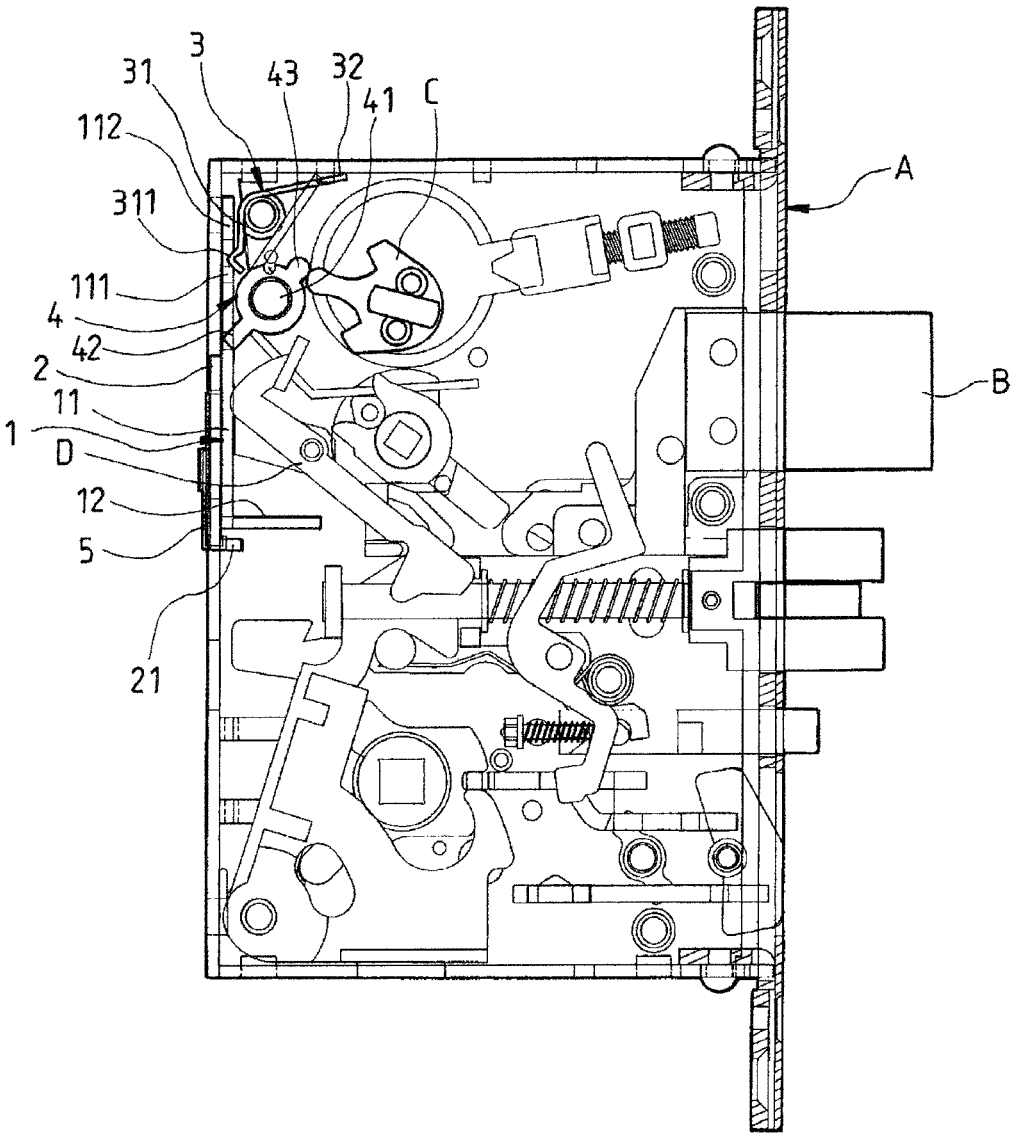
FIG. 5 is a schematic diagram showing a scenario when the door lock of FIG. 4 is locked.

FIG. 5 is a schematic diagram showing a scenario when the door lock A is locked. As illustrated, a lock heart C of the door lock A is turned to engage the second pin 43 of the lever 4 so that the lever 4 is turned counterclockwise. The first blocking piece 1 is then driven downward as the first pin 42 of the first blocking piece 1 is embedded into the first through hole 111. In the meantime, the bulge 311 of the positioning piece 3 escapes the second through hole 112. As such, the second section 12 of the first blocking piece 1 blocks the lock tongue B of the door lock A, and the second blocking piece 2 blocks a swing arm D of the door lock A. Therefore, the door lock A remains in a locked state and cannot be opened without using a key to the door lock. Even though a burglar breaks into the house, for example, through a window, the door lock A cannot be opened from inside the house so that an enhanced anti-theft effect is achieved.

When the door lock A is unlocked, the lock hear C is turned and the lever 4 rotates clockwise. The first blocking piece 1 is moved upward and the blocking to the lock tongue B by the second section 12 of the first blocking piece 1 is released. Also, as the first blocking piece 1 is moved upward, the bulge 311 of the positioning piece 3 is again embedded into the second through hole 112 to prevent the first blocking piece 1 to move downward. The door lock A is therefore restored to an unlocked state, as shown in FIG. 4.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A anti-theft device for a door lock, the door lock having at least a lock tongue, a lock heart, and a swing arm, the anti-theft configured in the door lock and comprising:

a first blocking piece comprising a first section and a second section extended from the first section, the first section having a first through hole and a second through hole;

a second blocking piece having a hook at one end;

a torsion spring where the torsion spring and the second blocking piece are sequentially in this order and rotatably joined to the first blocking piece;

an elastic positioning piece having a bulge at one end; and a lever comprising an axle and a first pin extended radially from the axle;

wherein, when the door lock is locked, the lock heart of the door lock is turned to engage the lever so that the lever is turned as well; the first blocking piece is driven downward as the first pin of the first blocking piece is embedded into the first through hole; the second section of the first blocking piece as such blocks the lock tongue of the door lock, and the second blocking piece blocks the swing arm of the door lock; therefore, the door lock remains in a locked state and cannot be opened without using a key to the door lock;

when the door lock is unlocked, the lock heart is turned and the lever rotates towards an opposite direction; the first blocking piece is moved upward and the blocking to the lock tongue by the second section of the first blocking piece is released; the bulge of the positioning piece is embedded into the second through hole to prevent the first blocking piece from moving downward; and the door lock is therefore restored to an unlocked state.

2. The anti-theft device according to claim 1, wherein the positioning piece is a torsion spring having a first end segment and a second end segment both extended for appropriate lengths; and the bulge is configured on the first end segment.

3. The anti-theft device according to claim 1, wherein the lever further has a second pin extended radially from the axle and diametrically opposing to the first pin; the second pin is engaged by the lock heart so that, when the lock heart is turned, the lever is turned as well.

* * * * *